US011746670B2

(12) United States Patent
Menheere et al.

(10) Patent No.: US 11,746,670 B2
(45) Date of Patent: Sep. 5, 2023

(54) IMPELLER SHROUD ASSEMBLY AND METHOD FOR OPERATING SAME

(71) Applicant: Pratt & Whitney Canada Corp., Longueuil (CA)

(72) Inventors: David Menheere, Norval (CA); Timothy Redford, Cambellville (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 17/562,306

(22) Filed: Dec. 27, 2021

(65) Prior Publication Data

US 2023/0203962 A1 Jun. 29, 2023

(51) Int. Cl.
*F01D 11/00* (2006.01)
*F01D 11/22* (2006.01)

(52) U.S. Cl.
CPC ..... *F01D 11/22* (2013.01); *F01D 11/001* (2013.01); *F05D 2220/32* (2013.01); *F05D 2240/11* (2013.01)

(58) Field of Classification Search
CPC .... F01D 11/22; F01D 11/001; F05D 2240/11; F05D 2220/32
See application file for complete search history.

(56) References Cited

U.S. PATENT DOCUMENTS 3,994,620 A 11/1976 Spraker, Jr.
5,263,816 A * 11/1993 Weimer ..... F04D 29/052 415/173.1
5,362,202 A * 11/1994 Derouet ..... F04D 29/563 415/173.2
5,403,165 A * 4/1995 Lehe ..... F04D 13/04 417/406
6,273,671 B1 8/2001 Ress, Jr.
9,587,507 B2 3/2017 Ottow
10,309,410 B2 * 6/2019 Ottow ..... F04D 29/162
10,408,226 B2 * 9/2019 Ottow ..... F04D 29/162
10,704,560 B2 * 7/2020 Aker ..... F04D 29/023
10,731,666 B2 * 8/2020 Skertic ..... F04D 29/622
10,935,044 B2 3/2021 Ottow
(Continued)

OTHER PUBLICATIONS

EP search report for EP22215981.6 dated Mar. 13, 2023.

*Primary Examiner* — David E Sosnowski
*Assistant Examiner* — Theodore C Ribadeneyra
(74) *Attorney, Agent, or Firm* — GETZ BALICH LLC

(57) ABSTRACT

An impeller shroud assembly for a gas turbine engine includes an annular impeller shroud disposed about an axial centerline. The impeller shroud includes a shroud inducer portion and a shroud exducer portion disposed radially outward of the shroud inducer portion and extending to an outer radial end of the impeller shroud. The shroud inducer portion and the shroud exducer portion defining an impeller-facing surface of the impeller shroud. The impeller shroud has a pivot point defined between the shroud inducer portion and the shroud exducer portion. The impeller shroud assembly further includes a clearance control device connected to the shroud exducer portion of the impeller shroud proximate the outer radial end. The clearance control device is configured to pivot the shroud exducer portion of the impeller shroud about the pivot point between a first axial position and a second axial position.

20 Claims, 9 Drawing Sheets

(56) References Cited

U.S. PATENT DOCUMENTS

| | | | | |
|---|---|---|---|---|
| 2002/0071763 | A1* | 6/2002 | Brandl | F01D 11/22 415/173.2 |
| 2008/0134659 | A1* | 6/2008 | Schwarz | F04D 29/059 415/129 |
| 2015/0016946 | A1* | 1/2015 | Ottow | F04D 29/622 415/173.2 |
| 2015/0218959 | A1* | 8/2015 | Barb | F01D 11/22 415/173.1 |
| 2016/0333721 | A1* | 11/2016 | McCaffrey | F01D 11/22 |
| 2017/0198709 | A1* | 7/2017 | Moniz | F04D 17/025 |
| 2017/0234147 | A1* | 8/2017 | Moniz | F16J 15/164 415/173.1 |
| 2017/0342994 | A1* | 11/2017 | Nesteroff | F04D 29/162 |
| 2017/0342995 | A1* | 11/2017 | Ottow | F01D 11/22 |
| 2017/0343001 | A1* | 11/2017 | Nesteroff | F04D 29/622 |
| 2017/0343002 | A1* | 11/2017 | Ottow | F04D 29/162 |
| 2019/0128286 | A1* | 5/2019 | Skertic | F01D 11/24 |
| 2019/0353180 | A1 | 11/2019 | Ottow | |
| 2019/0383304 | A1* | 12/2019 | Aker | F04D 29/4206 |
| 2020/0332673 | A1* | 10/2020 | Joly | F04D 27/0246 |
| 2020/0408224 | A1* | 12/2020 | Nesteroff | F04D 29/162 |

* cited by examiner

IMPELLER SHROUD ASSEMBLY AND METHOD FOR OPERATING SAME

TECHNICAL FIELD

This disclosure relates generally to compressors for aircraft gas turbine engines and more particularly to impeller shroud clearance control systems for centrifugal compressors.

BACKGROUND OF THE ART

Compressors are commonly included in gas turbine engines for pressurizing intake air which will be mixed with fuel and ignited to generate combustion gases used for operation of the gas turbine engine. In some gas turbine engines, one or more centrifugal compressors may be included which have a rotatable impeller circumscribed by an impeller shroud. The impeller and the impeller shroud may be positioned relative one another with a clearance gap therebetween, to ensure that the impeller does not contact the impeller shroud during operation of the compressor. It is desirable to limit the magnitude of the clearance gap, however, because air leakage through the clearance gap may reduce the efficiency of the compressor. There is a need in the art, therefore, for improved systems and methods for controlling the clearance gap between an impeller and an impeller shroud for gas turbine engine compressors.

SUMMARY

It should be understood that any or all of the features or embodiments described herein can be used or combined in any combination with each and every other feature or embodiment described herein unless expressly noted otherwise.

According to an aspect of the present disclosure, an impeller shroud assembly for a gas turbine engine includes an annular impeller shroud disposed about an axial centerline. The impeller shroud includes a shroud inducer portion and a shroud exducer portion disposed radially outward of the shroud inducer portion and extending to an outer radial end of the impeller shroud. The shroud inducer portion and the shroud exducer portion defining an impeller-facing surface of the impeller shroud. The impeller shroud has a pivot point defined between the shroud inducer portion and the shroud exducer portion. The impeller shroud assembly further includes a clearance control device connected to the shroud exducer portion of the impeller shroud proximate the outer radial end. The clearance control device is configured to pivot the shroud exducer portion of the impeller shroud about the pivot point between a first axial position and a second axial position.

In any of the aspects or embodiments described above and herein, the shroud inducer portion and the shroud exducer portion may be a unitary structure of the impeller shroud.

In any of the aspects or embodiments described above and herein, the impeller shroud assembly may further include a casing arm mounted to the impeller shroud at the pivot point.

In any of the aspects or embodiments described above and herein, the impeller shroud may include an axially-extending member which extends from shroud exducer portion proximate the outer radial end and connects the shroud exducer portion to the clearance control device.

In any of the aspects or embodiments described above and herein, the clearance control device may include a plurality of cams circumferentially spaced about the axial centerline.

Each cam of the plurality of cams is in contact with the axially-extending member and configured to effect axial translation of the axially-extending member so as to pivot the shroud exducer portion of the impeller shroud about the pivot point between the first axial position and the second axial position.

In any of the aspects or embodiments described above and herein, the clearance control device may include a sync ring disposed about the axial centerline. The sync ring may be in contact with each cam of the plurality of cams and configured to effect axial translation of the axially-extending member by rotation of the sync ring about the axial centerline in a circumferential direction.

In any of the aspects or embodiments described above and herein, the clearance control device may include a hydraulic pressure source and an actuator body defining an annular channel in fluid communication with the axially-extending member. The actuator body may include one or more hydraulic ports providing fluid communication between the hydraulic pressure source and the annular channel.

In any of the aspects or embodiments described above and herein, the clearance control device may include at least one first magnet member. The axially-extending member may include at least one second magnet member mounted thereto. The at least one first magnet member may be disposed axially adjacent the at least one second magnet member.

In any of the aspects or embodiments described above and herein, the at least one first magnet member may be an electromagnet.

In any of the aspects or embodiments described above and herein, the impeller shroud assembly may further include at least one capacitive probe extending through the shroud exducer portion of the impeller shroud. The at least one capacitive probe may have a distal end defining a portion of the impeller-facing surface of the impeller shroud.

In any of the aspects or embodiments described above and herein, the impeller shroud assembly may further include a controller in signal communication with the at least one capacitive probe and the clearance control device. The controller may be configured to operate the clearance control device to pivot the shroud exducer portion of the impeller shroud about the pivot point between the first axial position and the second axial position.

According to another aspect of the present disclosure, a gas turbine engine includes a compressor including an impeller which is rotatable about an axial centerline of the gas turbine engine. The impeller includes a plurality of impeller blades. Each impeller blade of the plurality of impeller blades includes a blade inducer portion and a blade exducer portion. The gas turbine engine further includes an annular impeller shroud disposed about the axial centerline and axially adjacent the impeller. The impeller shroud includes a shroud inducer portion and a shroud exducer portion disposed radially outward of the shroud inducer portion and extending to an outer radial end of the impeller shroud. The shroud inducer portion and the shroud exducer portion define an impeller-facing surface of the impeller shroud which is spaced from the plurality of impeller blades by a clearance gap. The impeller shroud has a pivot point defined between the shroud inducer portion and the shroud exducer portion. The gas turbine engine further includes a clearance control device connected to the shroud exducer portion of the impeller shroud proximate the outer radial end. The clearance control device is configured to pivot the shroud exducer portion of the impeller shroud about the pivot point between a first axial position and a second axial position to adjust the clearance gap between the impeller shroud and the plurality of impeller blades.

In any of the aspects or embodiments described above and herein, the shroud inducer portion and the shroud exducer portion may be a unitary structure of the impeller shroud.

In any of the aspects or embodiments described above and herein, the gas turbine engine further includes an engine casing and a casing arm mounted to the engine casing and to the impeller shroud at the pivot point.

In any of the aspects or embodiments described above and herein, the impeller shroud may include an axially-extending member which extends from the outer radial end of the shroud exducer portion and connects the shroud exducer portion to the clearance control device.

In any of the aspects or embodiments described above and herein, the gas turbine engine may further include a diffuser disposed radially outward of the impeller and configured to direct a pressurized fluid flow from the impeller to a combustor of the gas turbine engine. The gas turbine engine may further include an annular seal located between and in contact with the diffuser and the axially-extending member.

According to another aspect of the present disclosure, a method for controlling a clearance between an impeller and an impeller shroud for a compressor of a gas turbine engine is provided. The method includes providing a pressurized fluid flow with the compressor by rotating the impeller of the compressor about an axial centerline of the gas turbine engine. The impeller includes a plurality of impeller blades. Each impeller blade of the plurality of impeller blades includes a blade inducer portion and a blade exducer portion. The method further includes controlling a clearance gap between the plurality of impeller blades and an impeller-facing surface of an annular impeller shroud, disposed about the axial centerline and axially adjacent the impeller, with a clearance control device connected to the impeller shroud proximate an outer radial end of the impeller shroud, by pivoting a shroud exducer portion of the impeller shroud, with the clearance control device, about a pivot point of the impeller shroud defined between a shroud inducer portion and the shroud exducer portion disposed radially outward of the shroud inducer portion.

In any of the aspects or embodiments described above and herein, the impeller shroud may be mounted to a casing arm at the pivot point.

In any of the aspects or embodiments described above and herein, the method may further include determining a distance of the clearance gap with at least one capacitive probe extending through the shroud exducer portion of the impeller shroud.

In any of the aspects or embodiments described above and herein, the step of controlling the clearance gap between the plurality of impeller blades and the impeller-facing surface of an impeller shroud may include controlling the clearance gap based on the distance of the clearance gap determined by the at least one capacitive probe.

The present disclosure, and all its aspects, embodiments and advantages associated therewith will become more readily apparent in view of the detailed description provided below, including the accompanying drawings.

DETAILED DESCRIPTION

Figure 1:
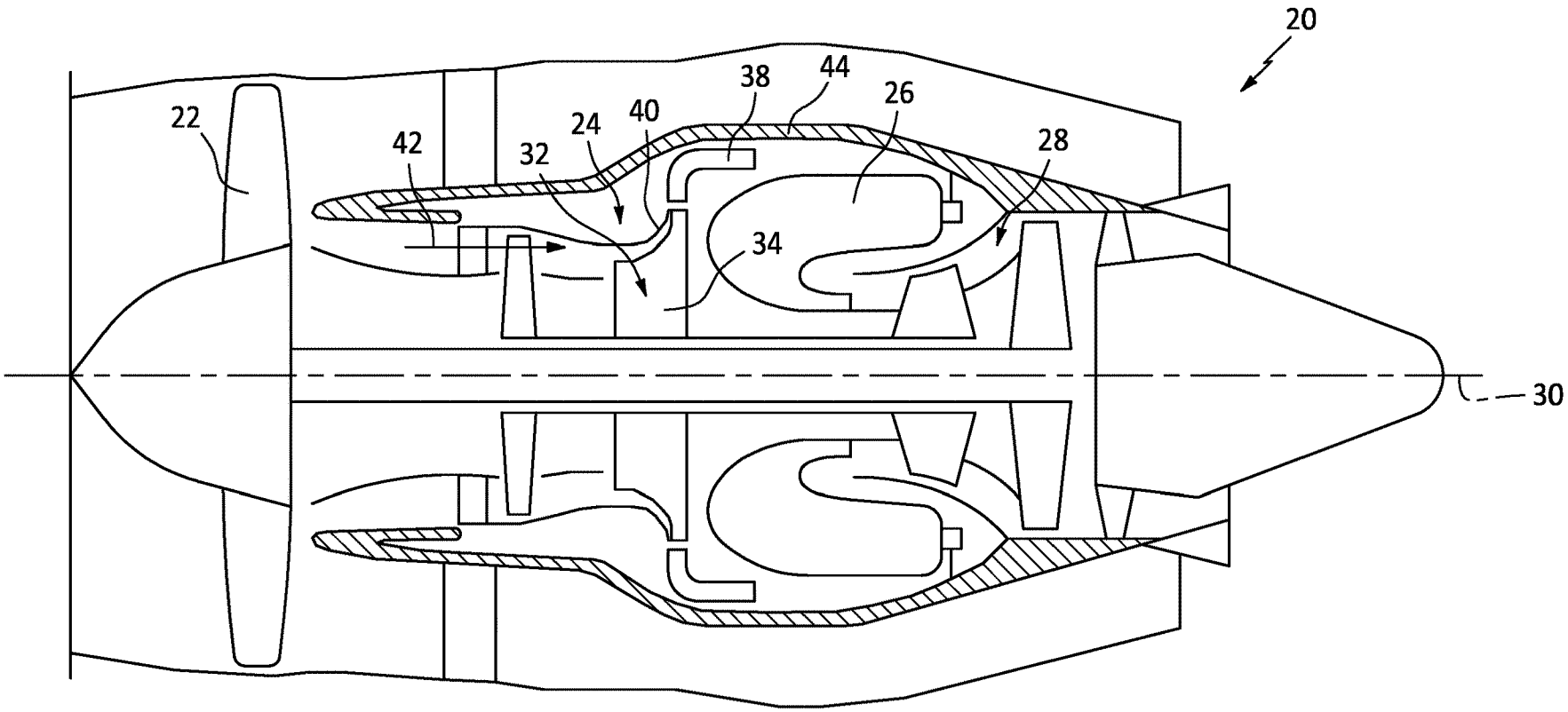
FIG. 1 illustrates a schematic cross-sectional view of a gas turbine engine, in accordance with one or more embodiments of the present disclosure.

FIG. 1 illustrates a gas turbine engine 20 of a type preferably provided for use in subsonic flight, generally comprising in serial flow communication a fan 22 through which ambient air is propelled, a compressor section 24 for pressurizing the air, a combustor 26 in which the compressed air is mixed with fuel and ignited for generating an annular stream of hot combustion gases, and a turbine section 28 for extracting energy from the combustion gases. FIG. 1 also illustrates an axial centerline 30 of the gas turbine engine 20. Although depicted as a turbofan gas turbine engine in the disclosed non-limiting embodiments, it should be understood that the concepts described herein are not limited to use with turbofans as the teachings may be applied to other types of gas turbine engines including those with single-spool or three-spool architectures.

The compressor section 24 of the gas turbine engine 20 includes one or more compressor stages, at least one of which includes a centrifugal compressor 32 The centrifugal compressor 32 includes a rotatable impeller 34 having a plurality of impeller blades 36 and a downstream diffuser assembly 38. The impeller 34 is configured to rotate within an annular impeller shroud 40 disposed about the axial centerline 30. The impeller 34 draws air axially, and rotation of the impeller 34 increases the velocity of a core gas flow 42 through the compressor 32 as the core gas flow 42 is directed though the rotating impeller blades 36, to flow in a radially outward direction under centrifugal forces into the diffuser assembly 38. The compressor 32 is at least partially housed within an engine casing 44 which surrounds and structurally supports the compressor 32, the impeller shroud 40, and the diffuser assembly 38.

Figure 2:
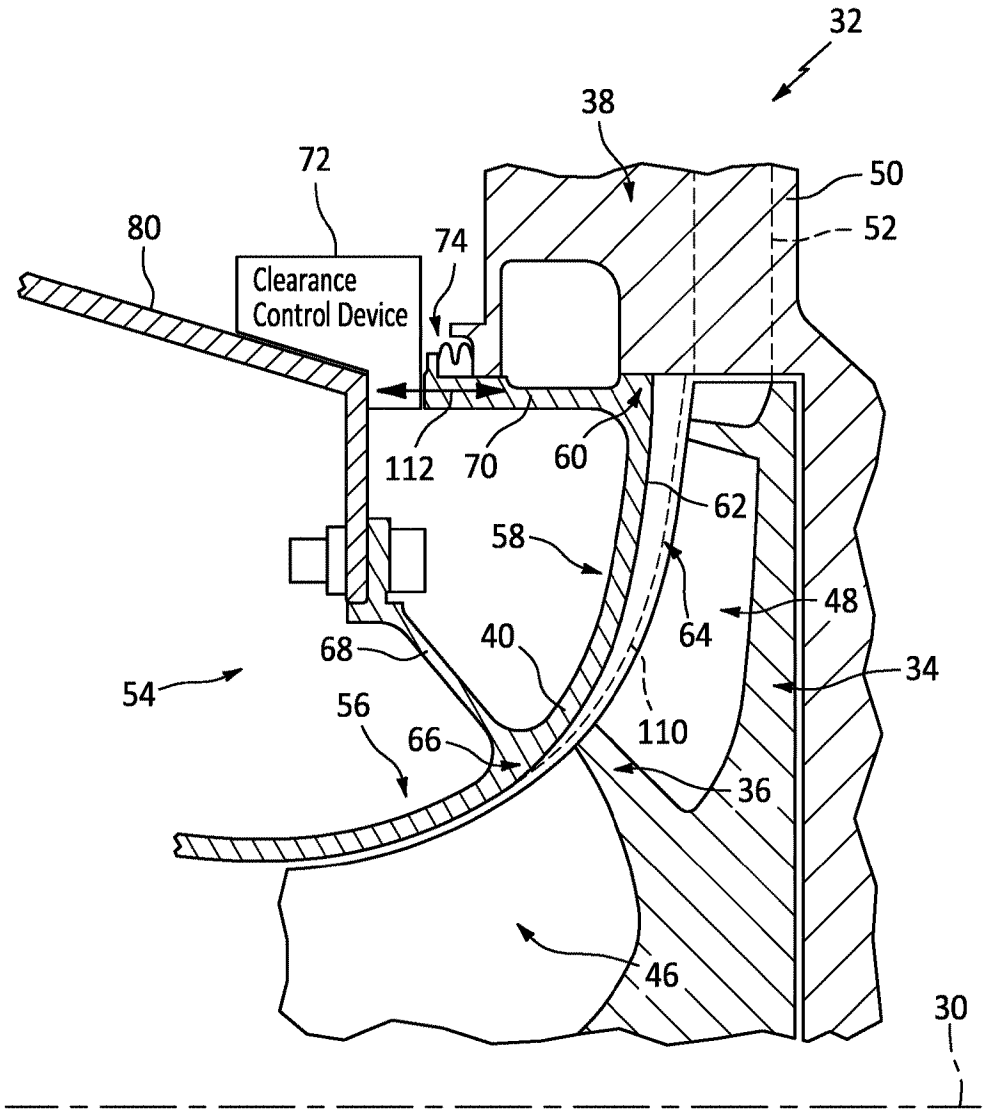
FIG. 2 illustrates a cross-sectional view of a portion of a compressor section for a gas turbine engine including a clearance control device, in accordance with one or more embodiments of the present disclosure.
Figure 3:
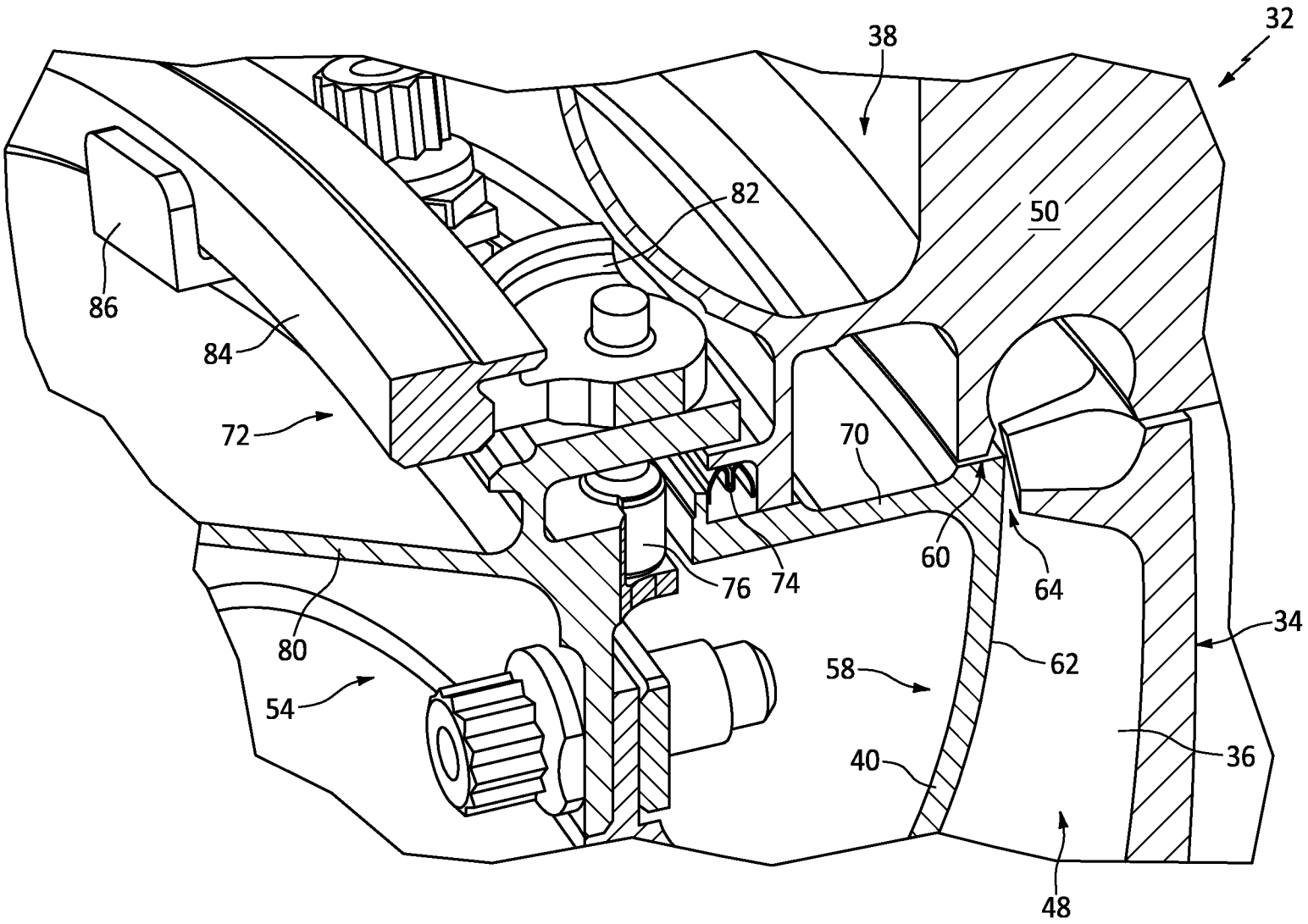
FIG. 3 illustrates a perspective view of a portion of a clearance control device for a compressor section of a gas turbine engine, in accordance with one or more embodiments of the present disclosure.
Figure 4:
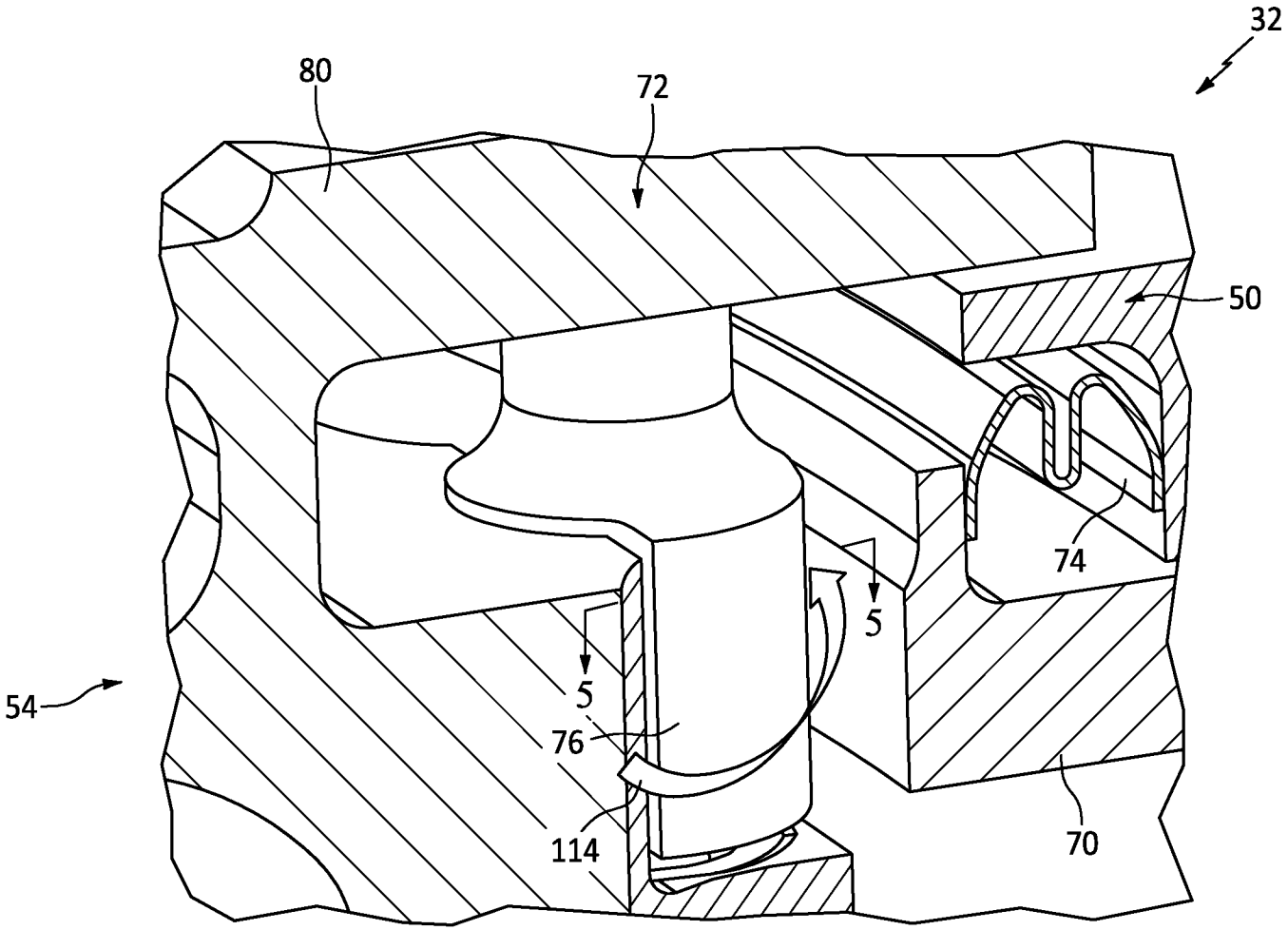
FIG. 4 illustrates a perspective view of a portion of the clearance control device of FIG. 3, in accordance with one or more embodiments of the present disclosure.

Referring to FIGS. 1 and 2, each of the impeller blades 36 of the impeller 34 may include an inducer portion 46 which may be an intake portion of the impeller blades 36. Each of the impeller blades 36 may also include an exducer portion 48, radially outward of the inducer portion 46, which may be an output end of the impeller blades 36

The diffuser assembly 38 (hereinafter the "diffuser" 38) includes an annular diffuser case 50 which radially circumscribes the impeller blades 36 of the impeller 34. The diffuser case 50 defines a diffuser passage 52 providing the fluid connection between the impeller 34 and the combustor 26, thereby allowing the impeller 34 to be in serial flow communication with the combustor 26.

Referring to FIG. 2, an impeller shroud assembly 54 of the present disclosure includes the impeller shroud 40 which encases the impeller blades 36 of the impeller 34. The impeller shroud 40 includes an inducer portion 56 and an exducer portion 58 disposed radially outward of the inducer portion 56 and extending to an outer radial end 60 of the impeller shroud 40. In some embodiments, the outer radial end 60 of the impeller shroud 40 may be in sliding contact with the diffuser case 50. In some other embodiments, the outer radial end 60 may be spaced (e.g., radially spaced) from the diffuser case 50. The inducer portion 56 of the impeller shroud 40 is positioned generally adjacent the inducer portion 46 of the impeller blades 36. Similarly, the exducer portion 58 of the impeller shroud 40 is positioned generally adjacent the exducer portion 48 of the impeller blades 36. The inducer portion 56 and the exducer portion 58 of the impeller shroud 40 define an impeller-facing surface 62 which is spaced from the plurality of impeller blades 36 by a clearance gap 64 (e.g., a blade tip clearance). In some embodiments, the inducer portion 56 and the exducer portion 58 of the impeller shroud 40 may form a unitary structure of the impeller shroud 40. The term "unitary structure," as used herein, means a single component, wherein all elements of the impeller shroud 40 (e.g., the inducer portion 56 and the exducer portion 58) are an inseparable body; e.g., formed of a single material, or a weldment of independent elements, etc.

As will be discussed in further detail, the impeller shroud 40 includes a pivot point 66 which is defined between the inducer portion 56 and the exducer portion 58 of the impeller shroud 40. The impeller shroud assembly 54 includes a casing arm 68 mounted to the impeller shroud 40 at or proximate the pivot point 66. The casing arm 68 may directly or indirectly mount the impeller shroud 40 to the engine casing 44 or other fixed structure of the gas turbine engine 20 to provide support to the impeller shroud 40 at or proximate the pivot point 66. In some embodiments, the impeller shroud 40 may include an axially-extending member 70 which extends outward from the exducer portion 58 of the impeller shroud 40 in a substantially axial direction (e.g., in an axial direction away from the impeller blades 36). The axially-extending member 70 may be mounted to the exducer portion 58 at or proximate the outer radial end 60. In some embodiments, the casing arm 68 and/or the axially-extending member 70 may form part of the unitary structure of the impeller shroud 40.

The clearance gap 64 between the impeller shroud 40 and the impeller blades 36 is selected such that a rub between the impeller blades 36 and the impeller-facing surface 62 of the impeller shroud 40 will not occur throughout an anticipated range of operating conditions for the compressor 32. A rub is any impingement of the impeller blades 36 on the impeller shroud 40. However, the clearance gap 64 between the impeller shroud 40 and the impeller blades 36 allows some amount of core gases to flow between the impeller shroud 40 and the impeller blades 36, thereby bypassing (e.g., leaking past) the impeller blades 36 and reducing the efficiency of the compressor 32. Accordingly, it is desirable to limit the clearance gap 64 between the impeller blades and the impeller shroud 40 to only the distance necessary to prevent rubbing between the impeller blades 36 and the impeller shroud 40, and thereby minimize leakage past the impeller blades 36.

The precise axial and radial positions of impeller blades may vary throughout the range of operating conditions for a compressor (e.g., the compressor 32), for example, as a result of compressor loading, thermal growth, and other operational factors. During some operating conditions of a compressor, such as when the compressor is coming up to speed during a start-up, the impeller blades may "lean" toward the impeller shroud (a phenomenon sometimes referred to as "nodding"). In this condition, outer radial portions of the impeller blades (e.g., the exducer portion 48) may experience greater axial displacement toward the impeller shroud than inner radial portions of the impeller blades (e.g., the inducer portion 46). In some conventional compressors of which we are aware, all or portions of an impeller shroud may be configured to axially translate relative to the adjacent impeller blades to control a clearance gap between the impeller shroud and the impeller blades. However, these conventional compressors may require complex actuation systems to control movement of the associated impeller shroud and may not be configured to adjust the clearance gap in a way that closely corresponds to the expected axial and radial displacement of the impeller blades, as previously discussed.

The present disclosure impeller shroud assembly 54 includes a clearance control device 72 connected to the outer radial end 60 of the impeller shroud 40. The clearance control device 72 is configured to axially move the impeller shroud 40 (e.g., along the axial direction 112) proximate the outer radial end 60 so as to pivot the exducer portion 58 of the impeller shroud 40 about the pivot point 66 between a range of axial positions to control the clearance gap 64 between the impeller shroud 40 and the impeller blades 36. FIG. 2 illustrates a second position of the impeller-facing surface 62 (schematically illustrated by dashed line 110). As can be understood from the second position 110 of the impeller-facing surface 62, the actuation of the exducer portion 58 by the clearance control device 72 causes outer radial portions of the exducer portion 58 of the impeller shroud 40 to experience greater axial displacement than inner radial portions of the exducer portion 58. Accordingly, the impeller shroud 40 of the present disclosure may be actuated to more closely match the expected movement of the impeller blades 36, thereby minimizing the clearance gap 64. In other words, the deflected shape of the impeller shroud 40 can be tailored to the running shape of the impeller blades 36 of the impeller 34. Because of the minimal growth of the impeller blades 36 in the inducer portion 46, the corresponding inducer portion 56 of the impeller shroud 40 may remain substantially fixed radially inward of the pivot point 66, allowing the inducer portion 56 of the impeller shroud 40 to maintain a tight clearance gap 64 with the inducer portion 46 of the impeller blades 36.

In some embodiments, the impeller shroud assembly 54 further includes an annular seal 74 located between and in contact with the diffuser case 50 and the impeller shroud 40. For example, the annular seal 74 may be located between and in contact with the diffuser case 50 and the axially-extending member 70, as shown in FIG. 2. The annular seal 74 may be, for example, a w-seal or another suitable seal configured to accommodate relative axial movement between the impeller shroud 40 and the diffuser case 50 while preventing or minimizing leakage therebetween.

Figure 5:
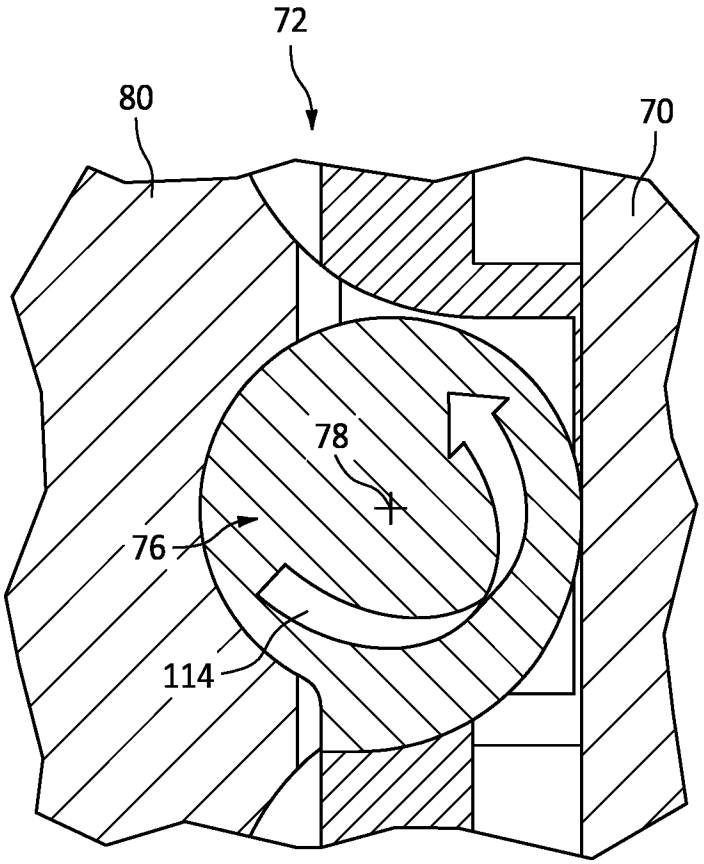
FIG. 5 illustrates a cross-sectional view of a portion of the clearance control device of FIG. 4 taken along Line 5-5, in accordance with one or more embodiments of the present disclosure.

Referring to FIGS. 2-5, in a first embodiment, the clearance control device 72 includes a plurality of cams 76 circumferentially spaced from one another about the axial centerline 30. Each of the plurality of cams 76 may be in contact with the impeller shroud 40. For example, each of the plurality of cams 76 may contact the axially-extending member 70 of the impeller shroud 40 and configured to effect axial translation of the axially-extending member 70 so as to pivot the exducer portion 58 of the impeller shroud 40 about the pivot point 66. Each of the plurality of cams 76 is configured to rotate about a respective cam axis 78 which may be substantially radial with respect to the axial centerline 30. Each of the plurality of cams 76 may have an asymmetrical cross-sectional shape (e.g., a "snail drop" cam as shown in FIG. 5) such that rotation of the respective cams of the plurality of cams 76 is configured to effect axial translation of the axially-extending member 70 as the plurality of cams 76 each rotate about their respective cam axes 78 (e.g., in rotational direction 114). The plurality of cams 76 may be an annular frame member 80 which may be directly or indirectly mounted to the engine casing 44 or other fixed structure of the gas turbine engine 20. In some embodiments, the casing arm 68 may also be mounted to the annular frame member 80.

Each of the plurality of cams 76 includes a respective gear 82 configured for rotation about the respective cam axis 78. The gear 82 may be located radially outside of the respective cam of the plurality of cams 76. The clearance control device 72 may include an annular sync ring 84 disposed about the axial centerline 30 and in contact with the gear 82 for each cam of the plurality of cams 76. Accordingly, rotation of the sync ring 84 in a circumferential direction about the axial centerline 30 causes the gear 82 for each cam of the plurality of cams 76 to rotate, thereby rotating each cam of the plurality of cams 76 about the respective cam axes 78. The clearance control device 72 may include one or more gear support members 86 mounted to the frame member 80. The sync ring 84 may be axially retained between the one or more gear support members 86 and the gear 82 for each cam of the plurality of cams 76. The clearance control device 72 may be rotated through actuation of one or more actuation devices (e.g., hydraulic, pneumatic, electro-mechanical actuators) which may be conventionally known in the art. Accordingly, for the sake of clarity, said actuation devices have been omitted from the figures and description herein and the present disclosure is not limited to any particular actuation devices for actuation of the sync ring 84.

Figure 6:
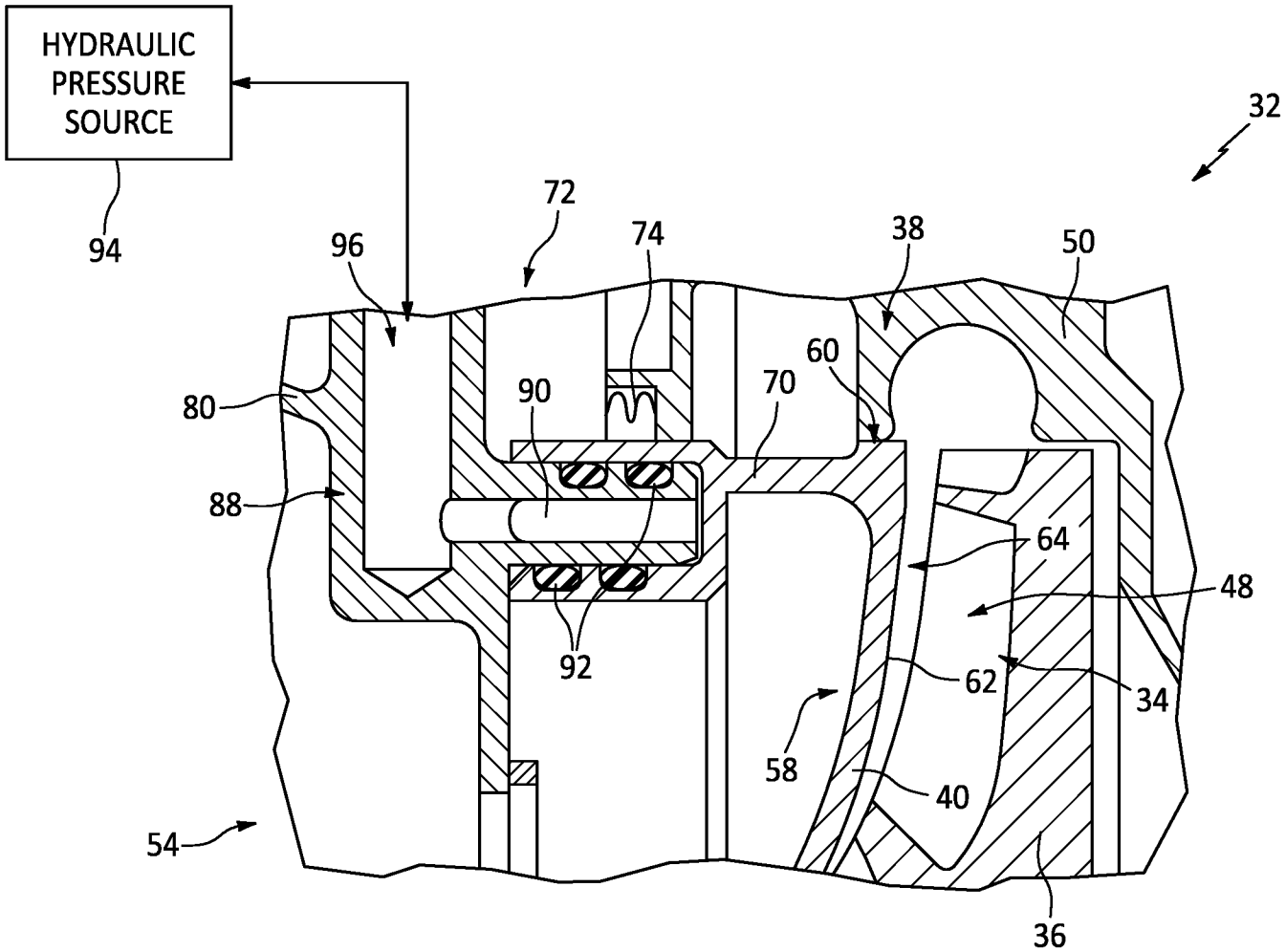
FIG. 6 illustrates a cross-sectional view of a portion of a compressor section for a gas turbine engine including a clearance control device, in accordance with one or more embodiments of the present disclosure.

Referring to FIGS. 2 and 6, in a second embodiment, the clearance control device 72 includes an annular actuator body 88 disposed about the axial centerline 30. In some embodiments, the actuator body 88 may be formed by a portion of the annular frame member 80. The actuator body 88 defines an annular channel 90 therein which is in fluid communication with the axially-extending member 70. At least a portion of the actuator body 88 may be axially retained within the axially-extending member 70 and the clearance control device 72 may include one or more annular seals 92 positioned between the actuator body 88 and the axially-extending member 70. The actuator body 88 further includes one or more hydraulic ports 96 providing fluid communication between a hydraulic pressure source 94 and the annular channel 90. In some embodiments, the annular channel 90 may be defined by a plurality of fluidly-independent circumferential channel segments with each circumferential segment in fluid communication with the hydraulic pressure source 94 via one or more hydraulic ports 96. Accordingly, hydraulic fluid supplied to the annular channel 90 by the hydraulic pressure source 94 may be used to effect axial translation of the axially-extending member 70 relative to the actuator body 88, thereby pivoting the exducer portion 58 of the impeller shroud 40 about the pivot point 66. The hydraulic clearance control device of FIG. 6 may provide for control of the clearance gap 64 with fewer parts than mechanical control systems and may further provide hydraulic damping for the impeller shroud 40.

Figure 7:
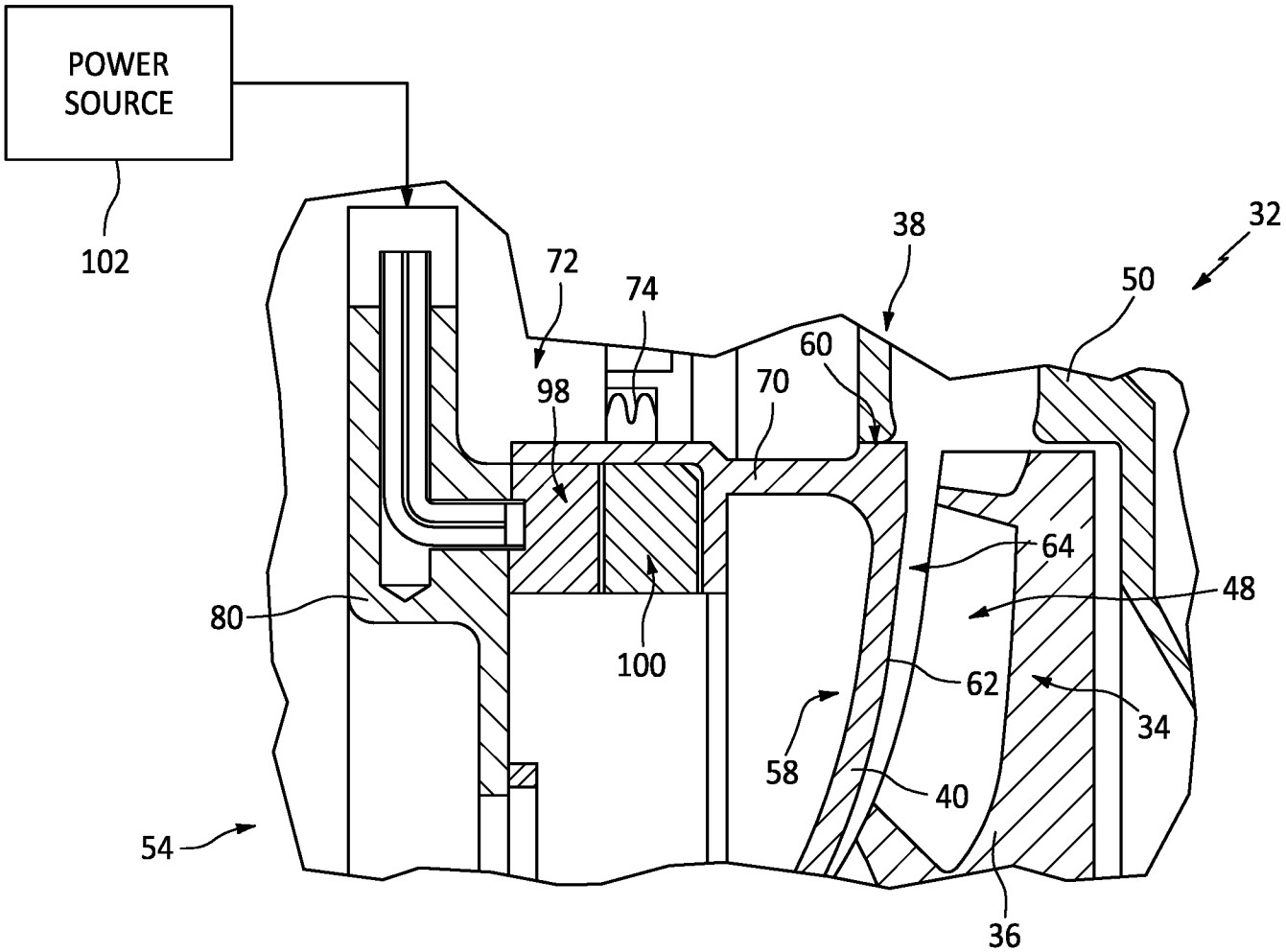
FIG. 7 illustrates a cross-sectional view of a portion of a compressor section for a gas turbine engine including a clearance control device, in accordance with one or more embodiments of the present disclosure.

Referring to FIGS. 2 and 7, in a third embodiment, the clearance control device 72 includes at least one first magnet member 98 and at least one second magnet member 100 positioned axially adjacent the at least one first magnet member 98. The at least one first magnet member 98 may be configured as an electromagnet in electrical communication with a power source 102. The at least one first magnet member 98 may be mounted to the frame member 80. The at least one second magnet member 100 may be configured as a permanent magnet or an electromagnet and may be mounted to the axially-extending member 70. The power source 102 may apply an electrical current to the at least one first magnet member 98 to develop a magnet field which is magnetically repulsive relative to the axially adjacent at least one second magnet member 100, thereby causing axial translation of the axially-extending member 70 relative to the clearance control device 72. The power source 102 may apply a variable electrical current to the at least one first magnet member 98 to control the strength of the magnetic field associated therewith and, hence, the magnetic repulsive force applied to the at least one second magnet member 100. In some embodiments, for example, the at least one first magnet member 98 and/or the at least one second magnet member 100 may be configured as annular rings, whereas in other embodiments for example, the at least one first magnet member 98 and/or the at least one second magnet member 100 may be configured as circumferential ring segments.

Figure 8:
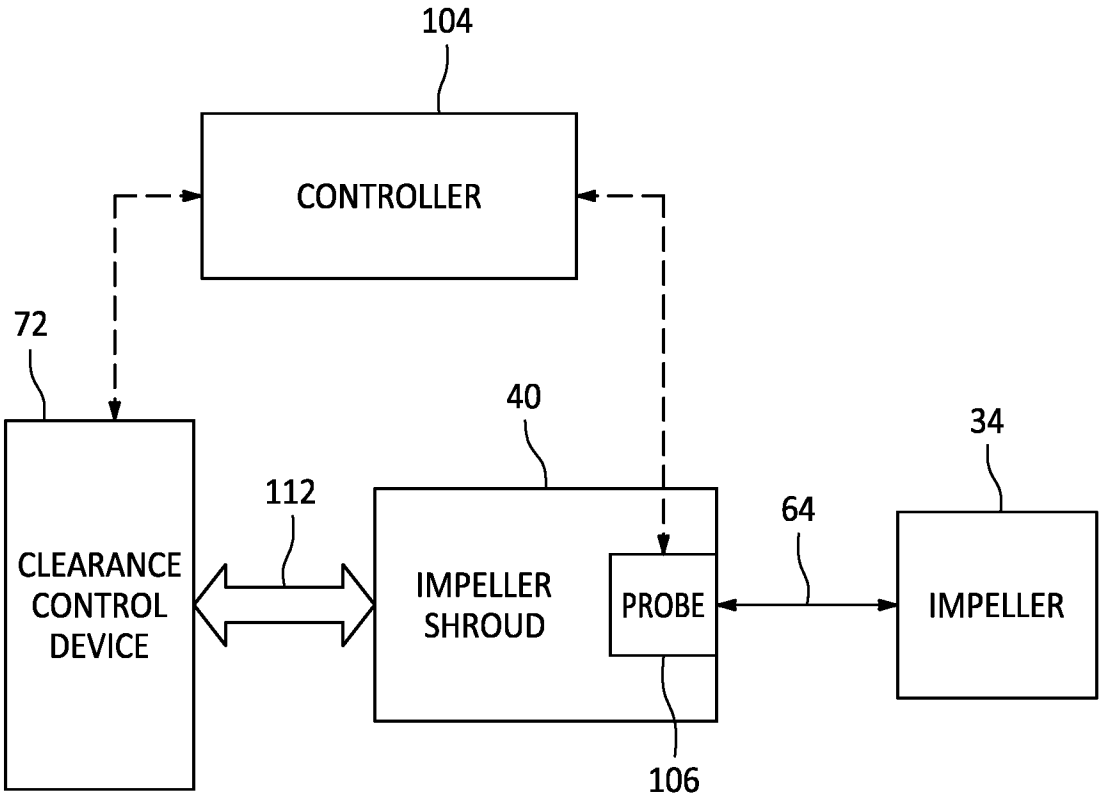
FIG. 8 illustrates a block diagram of a controller for use with a clearance control device for a compressor section, in accordance with one or more embodiments of the present disclosure.

Referring to FIG. 8, in some embodiments, the impeller shroud assembly 54 includes a controller 104 in signal communication with the clearance control device 72 and configured operate the clearance control device 72 to pivot the shroud exducer portion 58 of the impeller shroud 40 about the pivot point 66 to control the clearance gap 64. The controller 104 may include any type of computing device, computational circuit, or any type of process or processing circuit capable of executing a series of instructions that are stored in memory. The controller 104 may include multiple processors and/or multicore CPUs and may include any type of processor, such as a microprocessor, digital signal processor, co-processors, a micro-controller, a microcomputer, a central processing unit, a field programmable gate array, a programmable logic device, a state machine, logic circuitry, analog circuitry, digital circuitry, etc., and any combination thereof. The instructions stored in memory may represent one or more algorithms for controlling the aspects of the clearance control device 72, and the stored instructions are not limited to any particular form (e.g., program files, system data, buffers, drivers, utilities, system programs, etc.) provided they can be executed by the controller 104. The memory may be a non-transitory computer readable storage medium configured to store instructions that when executed by one or more processors, cause the one or more processors to perform or cause the performance of certain functions. The memory may be a single memory device or a plurality of memory devices. A memory device may include a storage area network, network attached storage, as well a disk drive, a read-only memory, random access memory, volatile memory, non-volatile memory, static memory, dynamic memory, flash memory, cache memory, and/or any device that stores digital information. One skilled in the art will appreciate, based on a review of this disclosure, that the implementation of the controller 104 may be achieved via the use of hardware, software, firmware, or any combination thereof. The controller 104 may also include input (e.g., a keyboard, a touch screen, etc.) and output devices (a monitor, sensor readouts, data ports, etc.) that enable the operator to input instructions, receive data, etc. In some embodiments, the controller 104 may operate the clearance control device 72 to establish a predetermined clearance gap 64 corresponding to a determined condition (i.e., a loading condition) of the compressor 32.

Figure 9:
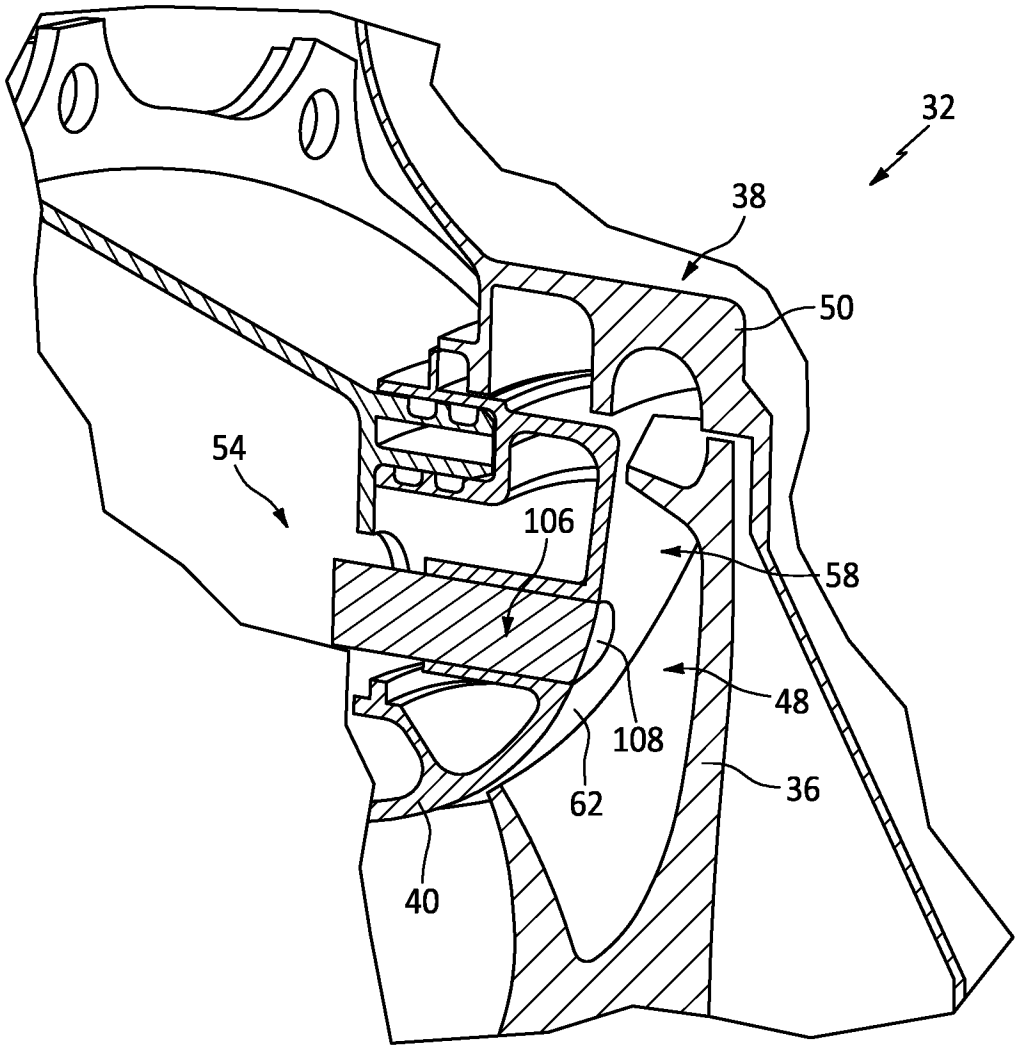
FIG. 9 illustrates a perspective sectional view of a portion of a compressor section for a gas turbine engine, in accordance with one or more embodiments of the present disclosure.

Referring to FIGS. 2, 8, and 9, in some embodiments, the impeller shroud assembly 54 may include at least one probe 106 configured to determine a magnitude (e.g., a distance) of the clearance gap 64 between the impeller-facing surface 62 and the plurality of impeller blades 36. The at least one probe 106 extends through the exducer portion 58 of the impeller shroud 40 with a distal end 108 of the at least one probe 106 positioned proximate or defining a portion of the impeller-facing surface 62 of the impeller shroud 40. In some embodiments, the at least one probe 106 may be a capacitive probe configured to determine the magnitude of the clearance gap 64 by measuring a capacitance between the impeller shroud 40 and the plurality of impeller blades 36. However, embodiments of the present disclosure are not limited to the use of capacitive probes for the at least one probe 106 and other probe configurations may be use including, for example, inductive probes, optical probes, and the like. In some embodiments, the at least one probe 106 may be in signal communication with the controller 104. The controller 104 may be configured to operate the clearance control device 72 to pivot the exducer portion 58 of the impeller shroud 40 about the pivot point 66 based on the measured clearance gap 64 provided by the at least one probe 106.

It is noted that various connections are set forth between elements in the preceding description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities. It is further noted that various method or process steps for embodiments of the present disclosure are described in the following description and drawings. The description may present the method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the description should not be construed as a limitation.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

While various aspects of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these particular features may be described individually, it is within the scope of the present disclosure that some or all of these features may be combined with any one of the aspects and remain within the scope of the present disclosure. References to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Accordingly, the present disclosure is not to be restricted except in light of the attached claims and their equivalents.

The invention claimed is:

1. An impeller shroud assembly for a gas turbine engine, the impeller shroud assembly comprising:

an annular impeller shroud disposed about an axial centerline, the impeller shroud comprising a shroud inducer portion and a shroud exducer portion disposed radially outward of the shroud inducer portion and extending to an outer radial end of the impeller shroud, the shroud inducer portion and the shroud exducer portion defining an impeller-facing surface of the impeller shroud, the impeller shroud having a pivot point defined between the shroud inducer portion and the shroud exducer portion; and a clearance control device connected to the shroud exducer portion of the impeller shroud proximate the outer radial end, the clearance control device operable to pivot the shroud exducer portion of the impeller shroud relative to the shroud inducer portion of the impeller shroud about the pivot point between a first axial position of the shroud exducer portion and a second axial position of the shroud exducer portion.

2. The impeller shroud assembly of claim 1, wherein the shroud inducer portion and the shroud exducer portion are a unitary structure of the impeller shroud.

3. The impeller shroud assembly of claim 1, further comprising a casing arm mounted to the impeller shroud at the pivot point.

4. The impeller shroud assembly of claim 1, wherein the impeller shroud includes an axially-extending member which extends from shroud exducer portion proximate the outer radial end and connects the shroud exducer portion to the clearance control device.

5. The impeller shroud assembly of claim 4, wherein the clearance control device includes a plurality of cams circumferentially spaced about the axial centerline, each cam of the plurality of cams in contact with the axially-extending member and configured to effect axial translation of the axially-extending member so as to pivot the shroud exducer portion of the impeller shroud about the pivot point between the first axial position and the second axial position.

6. The impeller shroud assembly of claim 5, wherein the clearance control device includes a sync ring disposed about the axial centerline and wherein the sync ring is in contact with each cam of the plurality of cams and configured to effect axial translation of the axially-extending member by rotation of the sync ring about the axial centerline in a circumferential direction.

7. The impeller shroud assembly of claim 4, wherein the clearance control device includes a hydraulic pressure source and an actuator body defining an annular channel in fluid communication with the axially-extending member and wherein the actuator body includes one or more hydraulic ports providing fluid communication between the hydraulic pressure source and the annular channel.

8. The impeller shroud assembly of claim 4, wherein the clearance control device includes at least one first magnet member and the axially-extending member includes at least one second magnet member mounted thereto, the at least one first magnet member disposed axially adjacent the at least one second magnet member.

9. The impeller shroud assembly of claim 8, wherein the at least one first magnet member is an electromagnet.

10. The impeller shroud assembly of claim 1, further comprising at least one capacitive probe extending through the shroud exducer portion of the impeller shroud, the at least one capacitive probe having a distal end defining a portion of the impeller-facing surface of the impeller shroud.

11. The impeller shroud assembly of claim 10, further comprising a controller in signal communication with the at least one capacitive probe and the clearance control device, the controller configured to operate the clearance control device to pivot the shroud exducer portion of the impeller shroud about the pivot point between the first axial position and the second axial position.

12. A gas turbine engine comprising:

a compressor comprising an impeller which is rotatable about an axial centerline of the gas turbine engine, the impeller comprising a plurality of impeller blades, each impeller blade of the plurality of impeller blades including a blade inducer portion and a blade exducer portion;

an annular impeller shroud disposed about the axial centerline and axially adjacent the impeller, the impeller shroud comprising a shroud inducer portion and a shroud exducer portion disposed radially outward of the shroud inducer portion and extending to an outer radial end of the impeller shroud, the shroud inducer portion and the shroud exducer portion defining an impeller-facing surface of the impeller shroud which is spaced from the plurality of impeller blades by a clearance gap, the impeller shroud having a pivot point defined between the shroud inducer portion and the shroud exducer portion; and a clearance control device connected to the shroud exducer portion of the impeller shroud proximate the outer radial end, the clearance control device configured to pivot the shroud exducer portion of the impeller shroud relative to the shroud inducer portion of the impeller shroud about the pivot point between a first axial position of the shroud exducer portion and a second axial position of the shroud exducer portion.

13. The gas turbine engine of claim 12, wherein the shroud inducer portion and the shroud exducer portion are a unitary structure of the impeller shroud.

14. The gas turbine engine of claim 12, further comprising an engine casing and a casing arm mounted to the engine casing and to the impeller shroud at the pivot point.

15. The gas turbine engine of claim 12, wherein the impeller shroud includes an axially-extending member which extends from the outer radial end of the shroud exducer portion and connects the shroud exducer portion to the clearance control device.

16. The gas turbine engine of claim 15, further comprising:

a diffuser disposed radially outward of the impeller and configured to direct a pressurized fluid flow from the impeller to a combustor of the gas turbine engine; and an annular seal located between and in contact with the diffuser and the axially-extending member.

17. A method for controlling a clearance between an impeller and an impeller shroud for a compressor of a gas turbine engine, the method comprising:

providing a pressurized fluid flow with the compressor by rotating the impeller of the compressor about an axial centerline of the gas turbine engine, the impeller comprising a plurality of impeller blades, each impeller blade of the plurality of impeller blades including a blade inducer portion and a blade exducer portion; and controlling a clearance gap between the plurality of impeller blades and an impeller-facing surface of an annular impeller shroud, disposed about the axial centerline and axially adjacent the impeller, with a clearance control device connected to the impeller shroud proximate an outer radial end of the impeller shroud, by pivoting a shroud exducer portion of the impeller shroud relative to the shroud inducer portion of the impeller shroud, with the clearance control device, about a pivot point of the impeller shroud defined between a shroud inducer portion and the shroud exducer portion disposed radially outward of the shroud inducer portion.

18. The method of claim 17, wherein the impeller shroud is mounted to a casing arm at the pivot point.

19. The method of claim 17, further comprising determining a distance of the clearance gap with at least one capacitive probe extending through the shroud exducer portion of the impeller shroud.

20. The method of claim 19, wherein the step of controlling the clearance gap between the plurality of impeller blades and the impeller-facing surface of an impeller shroud includes controlling the clearance gap based on the distance of the clearance gap determined by the at least one capacitive probe.

* * * * *